US005207689A

United States Patent [19]

Demeester

[11] Patent Number: 5,207,689

[45] Date of Patent: May 4, 1993

[54] DEPILATING APPLIANCE

[75] Inventor: Jacques Demeester, Croissy sur Seine, France

[73] Assignee: Braun Aktiengesellschaft, Kronberg im Taunus, Fed. Rep. of Germany

[21] Appl. No.: 804,711

[22] Filed: Dec. 12, 1991

Related U.S. Application Data

[60] Continuation of Ser. No. 566,292, Aug. 9, 1990, abandoned, which is a division of Ser. No. 297,435, Jan. 17, 1989, Pat. No. 4,960,422.

[30] Foreign Application Priority Data

Feb. 9, 1988 [FR] France ..... 88 01499

[51] Int. Cl.[5] ..... A61B 17/00

[52] U.S. Cl. ..... 606/133; 452/84

[58] Field of Search ..... 606/133; 452/82, 83, 452/84, 85

[56] References Cited

U.S. PATENT DOCUMENTS

| | | | |
|---|---|---|---|
| 1,923,415 | 8/1933 | Bingham . | |
| 2,900,661 | 8/1959 | Schnell | 17/11.1 R |
| 4,575,902 | 3/1986 | Alazet | 19/2 |

FOREIGN PATENT DOCUMENTS

| | | | |
|---|---|---|---|
| 1121291 | 1/1962 | Fed. Rep. of Germany . | |
| 788130 | 10/1935 | France . | |
| 916288 | 12/1946 | France . | |
| 943472 | 3/1949 | France | 17/11.1 R |
| 2556939 | 6/1985 | France . | |
| 420470 | 12/1934 | United Kingdom | 17/11.1 R |
| 461572 | 2/1937 | United Kingdom | 17/11.1 R |

*Primary Examiner*—Michael H. Thaler
*Attorney, Agent, or Firm*—Young & Thompson

[57] ABSTRACT

A depilating appliance comprises a rotary depilation roller formed by a series of blades placed side by side. The blades of the roller are movably mounted on their driving shaft so as to be capable of pivoting about an axis perpendicular to the shaft. The depilation blades are actuated by means of sliding bars which are capable of producing a pivotal displacement of the blades at least once per revolution of the roller so that one blade pivots in one direction, the following blade pivots in the opposite direction, and each blade pivots about a separate and distinct axis perpendicular to the driving shaft. Two adjacent blades are thus clamped against each other opposite to the work surface, the hairs being then pinched between the two blades in order to be removed.

3 Claims, 4 Drawing Sheets

DEPILATING APPLIANCE

This application is a continuation of application Ser. No. 07/566,292, filed Aug. 9, 1990, now abandoned, which is a division of application Ser. No. 297,435, filed Jan. 17, 1989, now U.S. Pat. No. 4,960,422.

BACKGROUND OF THE INVENTION

1. Field of the Invention

The present invention relates to small hand-held depilating appliances for the removal of unwanted hair.

2. Description of the Prior Art

In more precise terms, the invention relates to appliances of the type described in U.S. Pat. No. 4,575,902. In order to pluck-out hairs to be removed, this appliance has a rotary depilation roller formed by a series of thin disks placed side by side with a small clearance between them, and means for periodically gripping or pinching the hairs engaged between the disks. The hairs are then plucked-out by virtue of the rotation of the depilation roller.

In one of the forms of construction described in the patent cited above, the hairs are gripped by clamping against one of the faces of the rotary disks by means of the blades of a moving comb which are interengaged between these disks. Suitable means are accordingly provided for producing a periodic axial displacement of said comb with a view to applying the gripping blades of the comb against the rotary disks in order to trap the hairs to be plucked-out.

With a system of this type, however, it is difficult to obtain regularity of the gripping force from one disk to another. This regularity in fact depends on the accuracy of two elements : stacking of the disks and of the comb blades, the intervals of which must be strictly equal to each other.

In another form of construction described in the same patent, the disks are flexible and gripping of the hairs to be plucked-out is performed between two successive disks by deformation of the set of disks under the action of thrust members provided at each end. The arrangement in this case is such that the clamping action of the entire set of disks takes place at least once per revolution of the roller. However, a system of this type can operate only if the number of disks or the spacing between two successive disks is very small, which is an unfavorable factor for engagement of hairs in the depilation roller. This is detrimental to the efficiency of the appliance.

SUMMARY OF THE INVENTION

It is for the reasons given above that the object of the present invention is to provide an appliance of the same general type but differently designed so as to ensure that the hairs to be plucked-out are gripped between two successive disks in accordance with a process which ensures highly efficient gripping action without encountering the disadvantages set forth in the foregoing.

To this end, the appliance in accordance with the invention comprises a rotary depilation roller formed by a series of blades placed side by side. The distinctive feature of said appliance lies in the fact that said blades are movably mounted on their driving shaft so as to be capable of pivoting about an axis perpendicular to said shaft. Mechanical means are provided for actuating the blades and are capable of producing a pivotal displacement of said blades at least once per revolution of the roller so that one blade moves in one direction, the following blade moves in the opposite direction and each blade pivots about a distinct axis perpendicular to the driving shaft, so as to ensure clamping of the blades in groups of two in their respective portions which are located at that instant opposite to the work surface in order to grip or pinch the hairs which have been engaged between these blades in order to be plucked-out.

Thus at each revolution of the depilation roller, each roller blade is applied against an adjacent blade once or a number of times. This is achieved by means of a pivotal movement of these blades towards each other and not by means of deformation and compression of all the blades of the roller. In consequence, between the gripping stages, the blades of the roller can be spaced at a relatively substantial distance which facilitates engagement of hairs between said blades, thus achieving considerably enhanced efficiency of the appliance. Furthermore, regularity of the gripping action is note dependent solely on the precision of the mechanical means for actuating the roller blades. Moreover, although the function of pinching the hairs to be plucked-out is performed by these blades alone, their number is limited only by the power of the motor of the appliance.

In accordance with another distinctive feature of this appliance, each blade of the rotary depilation roller is provided at its periphery with one or a number of projecting portions constituting the gripping zones of said blades, said zones being disposed in the same alignment on the rotary depilation roller. This particular feature makes it possible to obtain higher efficiency of the appliance than with blades constituted by disks having a circular contour since there thus exist recesses between the projecting gripping zones, with the result that engagement of hairs within the depilation roller is facilitated to an even greater extent.

In an advantageous embodiment of the appliance under consideration, the rotary shaft for actuating the depilation blades has a polygonal cross-section such as a square cross-section, for example, and said blades are provided with a central opening also of polygonal cross-section within which said shaft is engaged, and in two diametrically opposite zones, the edge of the central opening of each hair-plucking blade is engaged in a transverse retaining channel within which it is endowed with freedom of angular displacement which permits pivotal motion of said blade about an axis perpendicular to the driving shaft.

In accordance with another distinctive feature of this advantageous embodiment, the mechanical means which ensure pivotal displacement of the depilation blades consist of two bars which are slidably mounted against one face of the rotary driving shaft parallel to the axis of this latter and which are provided with transverse grooves, a tooth provided on the edge of the central opening of a hair-plucking blade being adapted to engage within each transverse groove, said blades being thus coupled alternately with one of said sliding bars and with the other. Said two bars are actuated by control means for subjecting them to displacements in opposite directions in order to cause two successive depilation blades to pivot in opposite directions and thus to ensure clamping of the respective portions of these two blades which are located opposite to the work surface.

DESCRIPTION OF THE PREFERRED EMBODIMENTS

Figure 1:
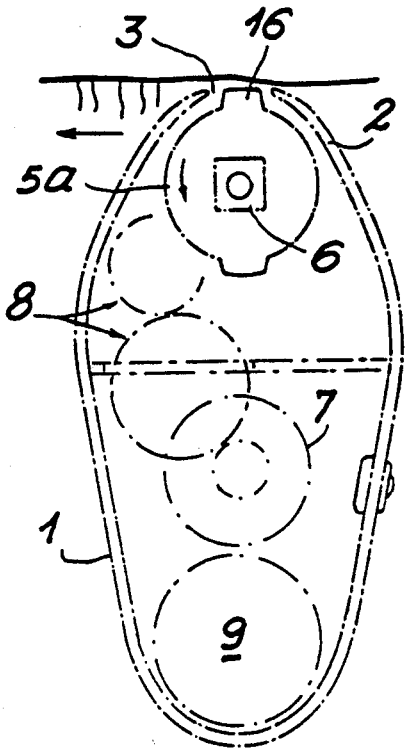
FIG. 1 is a schematic view in elevation showing a depilating appliance in accordance with the invention, the casing of the appliance being open.
Figure 2:
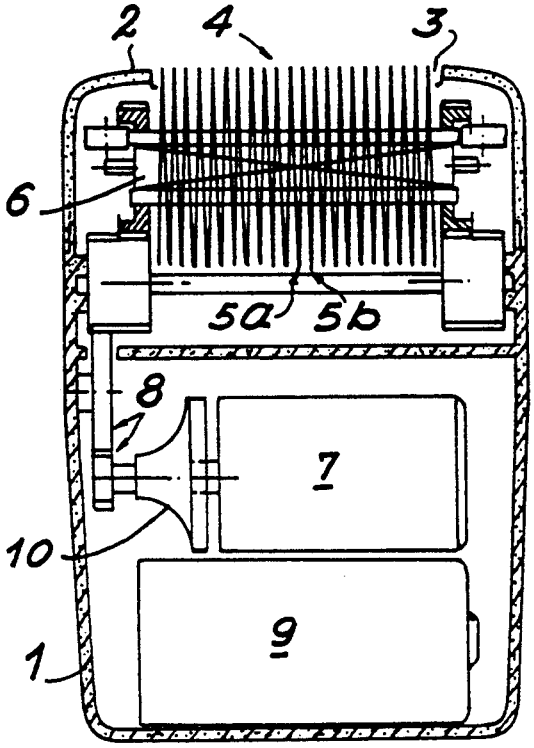
FIG. 2 is a schematic transverse sectional view of the same appliance, this latter being shown during use.
Figure 3:
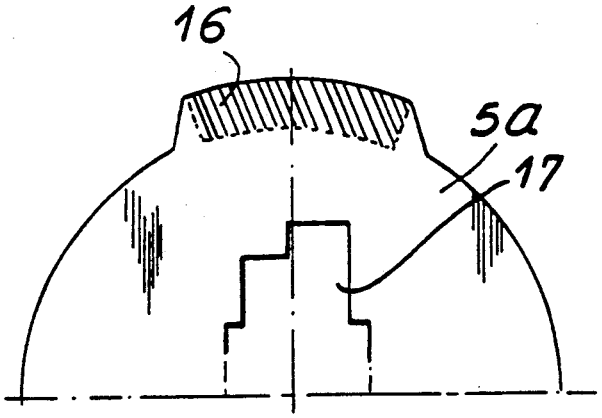
FIG. 3 is a partial view in elevation of one of the blades constituting the rotary depilation roller.
Figure 4:
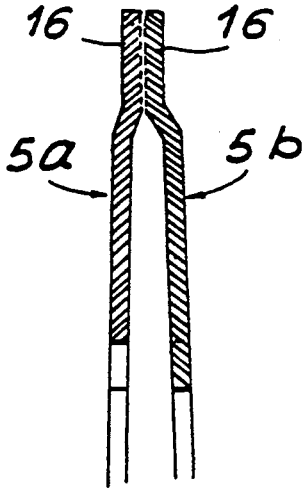
FIG. 4 is a partial sectional view of two of these blades shown at the moment of clamping of their respective gripping zone.

The appliance as illustrated in the drawings has a small casing 1 which can be held in one hand and contains all the mechanical elements of said appliance. Said casing has an elongated shape and is closed at one end by a cover 2 which virtually constitutes the frame of the working head or depilation head of the appliance. Said depilation head is thus removable with respect to the casing 1.

The cover 2 has an elongated opening 3 behind which is located a rotary depilation roller 4. This roller is constituted by a series of thin blades arranged in succession on a rotary shaft 6 and designated alternately by the references 5*a* and 5*b*. Said shaft is driven in rotation by a small electric motor 7 by means of a reduction gear train 8 or another mechanical system which makes it possible to obtain an optimum speed. This motor is supplied from a dry cell battery 9 which is also housed within the casing 1. Preferably, the shaft of the motor 7 is equipped with a fan rotor 10 so as to produce an overpressure within the casing 1 and thus to prevent penetration of plucked hairs through the opening 3.

Figure 7:
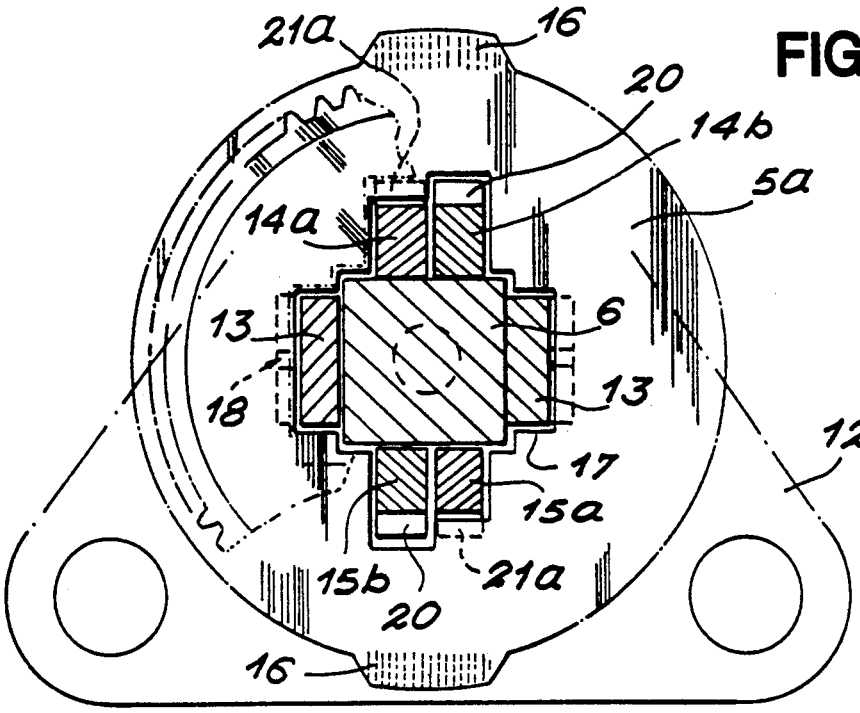
FIG. 7 is a transverse sectional view taken along line VII—VII of FIG. 6.
Figure 5:
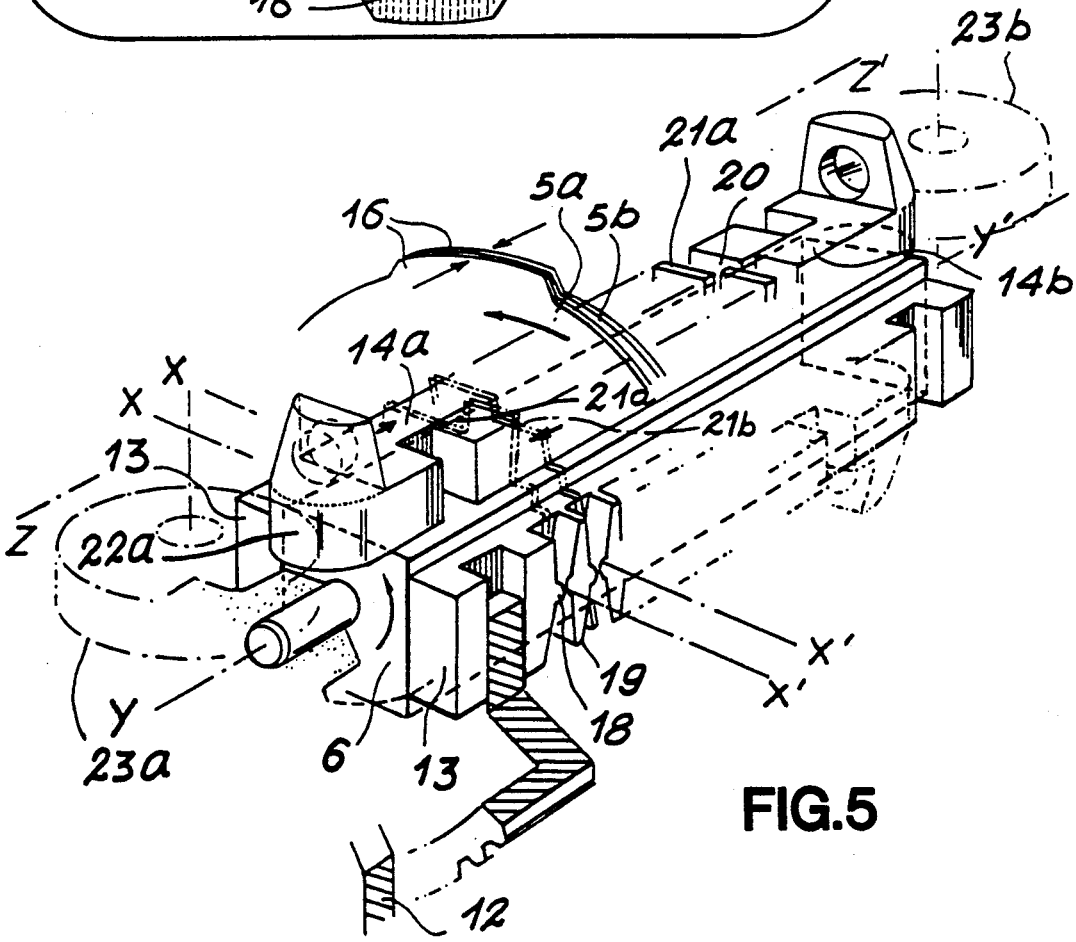
FIG. 5 is a view in perspective showing the depilation head of the appliance considered.

The rotary shaft 6 of the depilation head is placed between two end-plates 12 which are rigidly fixed to the cover 2 and carry the bearings in which the shaft-ends are rotatably mounted. As shown in FIGS. 5 and 7, the shaft has a square cross-section. Against two opposite faces of said shaft are disposed two flat strips 13 which are intended to serve as members for holding the depilation blades 5*a*, 5*b* in position. Against each of the two other faces of said shaft are placed two bars 14*a*, 14*b*, or respectively 15*a*, 15*b*, which are mounted so as to be capable of sliding in a direction parallel to the axis of the shaft 6. As will be explained hereinafter, said bars constitute the actuating members of the depilation blades 5*a*, 5*b* in order to produce periodic closure of their gripping zones.

Figure 11:
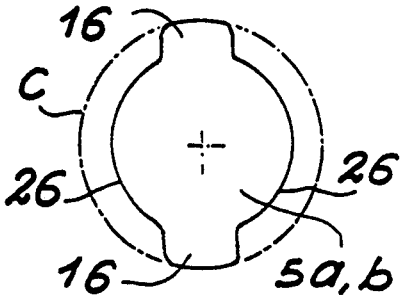
FIGS. 11 to 15 illustrate a number of different alternative designs of the contour of the blades of the rotary depilation roller.

In this connection, it is worthy of note that the depilation blades do not have the shape of disks of circular contour. In fact, as shown in FIG. 11, each blade is provided at its periphery with two projecting portions 16 which are located in diametrically opposite relation and are intended to constitute the gripping zones of the corresponding blade. With respect to the circle C which is circumscribed about the blade assembly, it can be considered that provision is accordingly made for two set-back portions 26 between the projecting portions 16. This has the effect of facilitating the engagement of hairs within the depilation roller. Apart from the projecting portions 16, each blade can have a circular contour or the like, this contour being so determined that the hairs to be plucked-out can be more readily engaged between the blades.

These various blades each have a central opening 17 of polygonal cross-section, the shape of which is such as to permit the insertion both of the rotary shaft 6 and of the different bars 13 and strips 14*a*, 14*b*, 15*a*, 15*b*. However, those portions of the internal edge of said opening 17 which are located opposite to the strips 13 are engaged within transverse channels 18 formed on the external face of said strips. This ensures good performance of the different blades 5 and maintains the requisite spacing between these latter. However, the channels 18 progressively increase in width on each side of their central portion opposite to which is provided a transverse rib 19 on each wall. This provides a possibility of pivotal displacement of each blade 5 about an axis X—X′ which is virtually materialized by the ribs 19 and extends at right angles with respect to the axis Y—Y′ of the rotary shaft 6. The different blades 5 are thus capable of pivoting about a series of separate and distinct axes X—X′ which are all perpendicular to the axis Y—Y′ so as to be operative in a working zone Z—Z′ (as shown in FIG. 5).

The sliding bars 14*a*, 14*b* and 15*a*, 15*b* of each pair are provided in their turn with a series of transverse grooves 20. However, in each pair of bars, there exists a relative positional displacement between the grooves of the two corresponding bars. So far as the blades 5 are concerned, provision is made on the edge of their central opening 17 for a projecting tooth 21*a* in the case of each blade 5*a* and 21*b* in the case of each blade 5*b*. The teeth 21*a* of the blades 5*a* are engaged in the grooves 20 of the two bars 14*a* and 15*a*. In regard to the teeth 21*b* of the blades 5*b*, they are engaged in the grooves 20 of the bars 14*b* and 15*b*. Thus the depilation blades are coupled with each of the two sliding bars of one and the same pair in alternate sequence.

Each sliding bar is adapted to carry an operating head 22*a* or 22*b* and, in each pair, the head of one of the bars is located at one end and the head of the other bar is located at the opposite end. On the same side as the opening 3 of the depilation head, provision is made at each end of the rotary depilation roller 4 for two wheels 23*a* and 23*b* which are intended to apply pressure respectively on the head 22*a* of a bar 14*a* or 15*a* and on the head 22*b* of a bar 15*b* or 14*b*. However, springs 24 have a tendency to hold the sliding bars in positions which normally maintain a spacing between the different blades 5*a* and 5*b*. It should be noted in this connection that, instead of springs 24 provided at the ends as is the case in the example shown in FIG. 6, it is possible to provide a single spring placed at the center.

Figure 6:
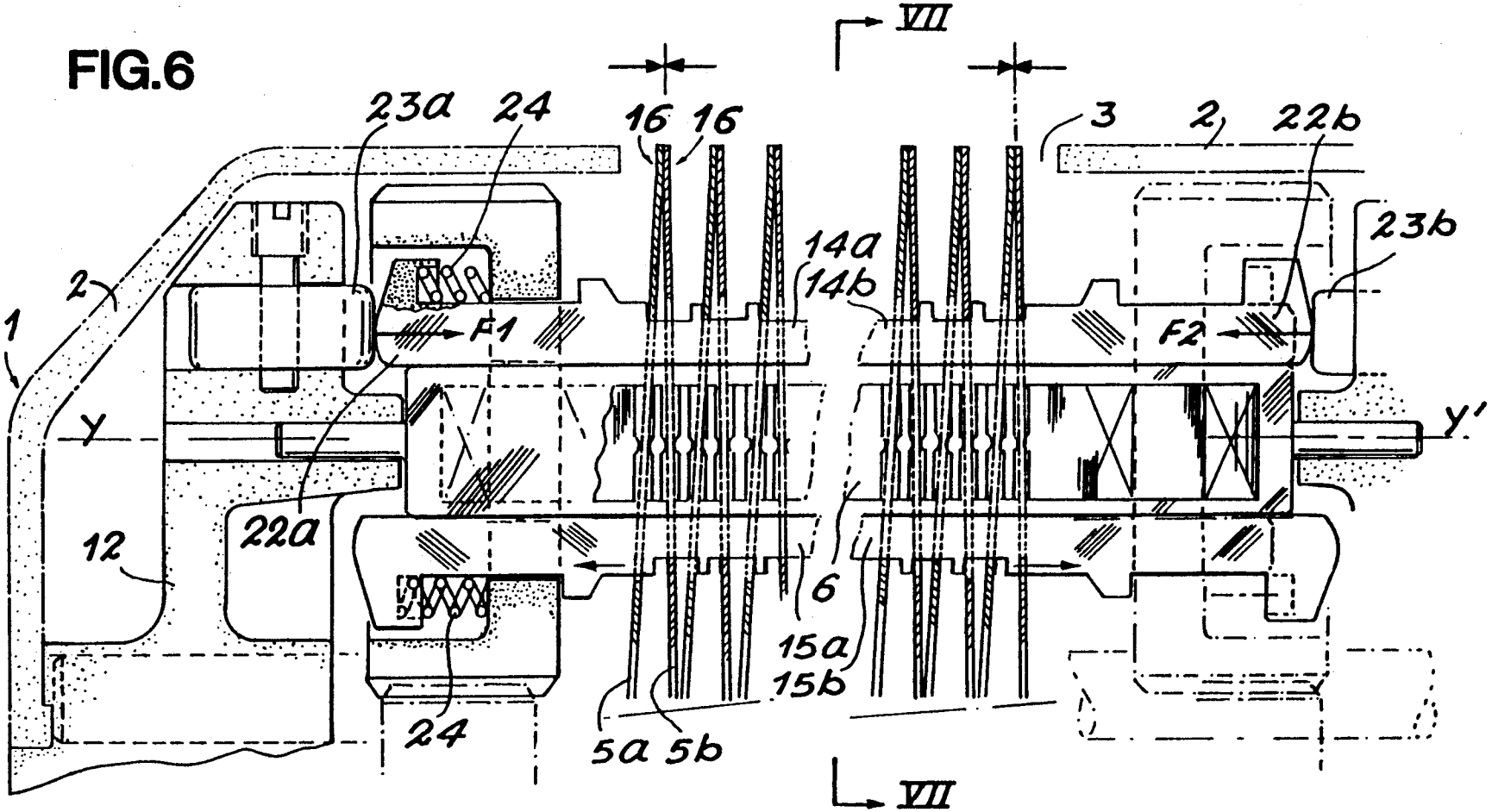
FIG. 6 is an axial sectional view of the same head with a portion broken away.

When the two sliding bars of one and the same pair such as the bars 14*a* and 14*b*, for example, reach the level of the wheels 23*a* and 23*b*, the first wheel thrusts the bar 14*a* in the direction of the arrow F1 whilst the second wheel thrusts the bar in the direction F2 (see FIG. 6). In view of the fact that the disks 5*a* are coupled with the bar 14*a*, this causes them to pivot in the clockwise direction about their axis X—X'. As to the disks 5*b*, they are caused to pivot in opposite directions under the action of displacement of the bar 14*b*. This has the effect of closing the projecting gripping portions 16 of two adjacent blades in pairs as shown in FIG. 6 as well as in the diagram of FIG. 9.

The arrangement is such that closure of the gripping zones 16 takes place while these latter are located opposite to the opening 3 of the cover 2 of the depilation head. The axes X—X' of pivotal displacement of the depilation blades are then located in a plane substantially parallel to the plane tangent to the working surface of the rotary depilation roller which is in contact with the skin. However, there can be an angular displacement in one direction or in the other.

Figure 8:
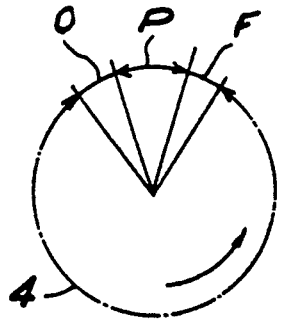
FIG. 8 is an explanatory diagram of the stages of clamping and opening of the depilation blades.

The diagram of FIG. 8 illustrates the different successive stages of relative inward and outward displacement of the gripping zones 16 of the depilation blades. In this figure, the reference F indicates the stage of closure of said gripping zones, the reference P indicates the so-called clamping stage proper and the reference 0 indicates the opening stage. The hairs to be plucked-out engage between the projecting portions 16 of the depilation blades during the stage F prior to clamping. These hairs are then gripped or pinched between the projecting zones of two successive blades during the stage P and, during this stage, the movement of rotation of the depilation disk 4 has the effect of plucking-out the pinched hairs. Finally, these hairs are ejected by centrifugal force during the stage of opening of the gripping zones 16 of the depilation blades.

In view of the fact that, in the example illustrated, provision is made for two pairs of control bars which are disposed at right angles with respect to the supporting strips 13, the depilation blades perform two gripping movements per revolution of the rotary depilation roller. It is for this reason that the blades 5*a* and 5*b* each carry two projecting portions 16 which are diametrically opposite and located opposite to either of the two pairs of control bars. Between each period of gripping of the depilation blades, these latter are restored by the springs 24 to substantially parallel positions.

Figure 9:
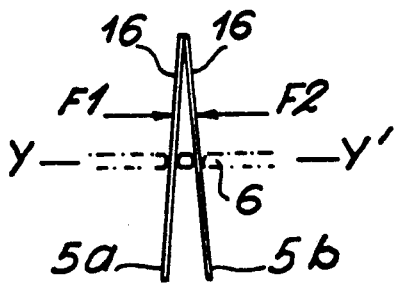
FIG. 9 is an explanatory diagram of the mode of gripping of said blades.
Figure 10:
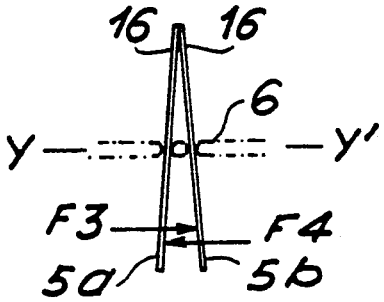
FIG. 10 is a similar diagram corresponding to an alternative embodiment.

Instead of having a direct action of relative inward displacement of those portions of the depilation blades 5*a*, 5*b* which are to be applied against each other, as is the case in the example illustrated in FIGS. 1 to 7 as well as in the diagram of FIG. 9, the control bars 14*a*, 14*b* and 15*a*, 15*b* can have an indirect action as contemplated in the diagram of FIG. 10. In such a case, the wheels 23*a*, 23*b* are placed in a diametrically opposite position with respect to the axis Y—Y' of the rotary shaft 6. The arrangement is then such that the control bars act in opposite directions, in the direction of the arrows F3 and F4, on two successive blades 5*a* and 5*b* so as to separate their corresponding portions. This causes said blades to pivot as before so as to ensure that their gripping portions 16 located on the opposite side are applied against each other. Thus the operation is accordingly the same as in the previous instance.

The wheels 23*a* and 23*b* can be replaced by cams or any other suitable elements which are capable of initiating the displacement of the pivotal motion control bars 14*a*, 14*b* and 15*a*, 15*b* each time these latter come into position opposite to said elements. The angular position of said control cams or wheels is so determined that the gripping zones of the depilation blades are applied against each other at the correct moment as a function of the ergonomic position of the appliance with respect to the skin to be depilated. It is possible to provide a single gripping action of the depilation blades per revolution. Conversely, however, it is also possible to provide a number of gripping actions greater than two during each revolution by utilizing a greater number of pairs of control bars.

When two or more gripping actions are provided per revolution, it is possible to construct an alternate arrangement of the gripping disks, these latter being always applied against each other in pairs. It is only necessary in this case to ensure that the disks are coupled differently with the control bars of the different pairs of bars. Thus, the arrangement can be such that the first pair of bars produces action on the disks located in positions 1 and 2 and so on whilst the second pair produces action on the disks located in positions 2 and 3 and so on.

In this connection, many alternative forms of construction may be contemplated. For example, the number of gripping movements per revolution could be increased in order to provide the possibility of reducing the speed of rotation of the depilation roller with a view to avoiding an excessively abrupt hairplucking action and consequently a risk of breaking of the hairs.

As indicated in FIGS. 12 to 15, the hair-plucking blades can have a contour other than that of the blades 5*a* and 5*b* which are illustrated in FIG. 11 and which are provided in the appliance shown in FIGS. 1 to 7.

Figure 12:
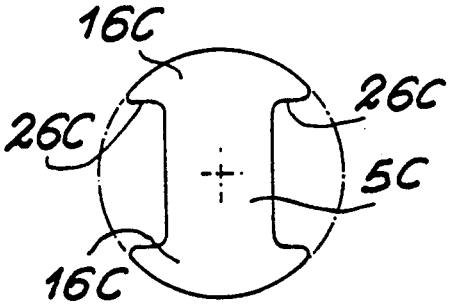

Thus FIG. 12 represents an alternative embodiment in which the gripping portions 16*c* of the corresponding blades 5*c* have a shape which is different from that proposed earlier. These projecting portions are separated from each other by hollowed-out zones 26*c* having the intended function of facilitating the engagement of plucked-out hairs.

Figure 13:
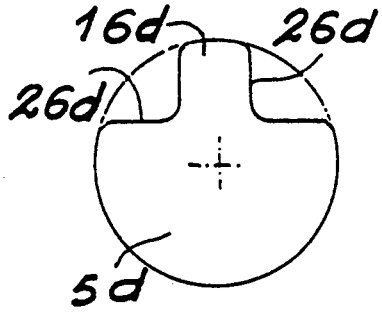

FIG. 13 represents an alternative embodiment in which the corresponding blades 5*d* have a single projecting gripping portion 16*d* and two hollowed-out zones 26*d*, one zone being located on each side of said projecting portion. In such a case, the depilation head is designed to carry out a single gripping movement per revolution.

Figure 14:
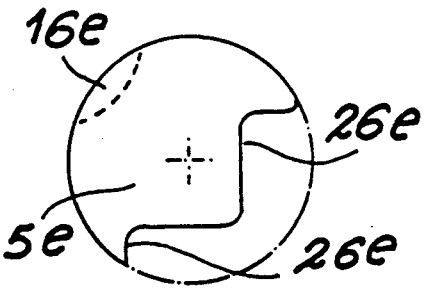

FIG. 14 represents another alternative embodiment which is also designed for the case of a single gripping movement per revolution. The corresponding blades 5*e* have a circular contour substantially over one-half of their periphery and two stepped recesses 26*e* in the remainder of their periphery. Provision is made in this case for a single gripping zone 16*e* at an intermediate point of the length of the circular portion.

Figure 15:
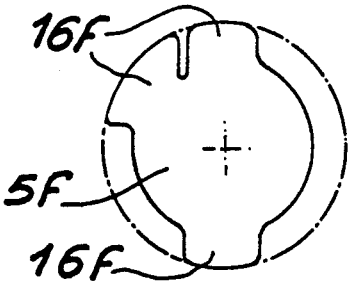

FIG. 15 shows yet another alternative embodiment in which the corresponding blades 5*f* have three distinct gripping zones 16*f*.

However, many other alternative embodiments could be contemplated for the contour of the depilation blades of the appliance under consideration.

As has already been indicated, the recessed portions provided between the projecting gripping portions are intended to facilitate the engagement of hairs to be plucked-out within the depilation roller. These portions are also intended to produce a combing effect on the hairs which are thus drawn into a position in which they are oriented in a direction parallel to the blades, which is also of a nature to facilitate the engagement of hairs between the blades. However, the projecting portions in contact with the skin can be of greater length than that of the gripping zone proper (see, for example, the case of the alternative embodiments of FIGS. 12, 13 and 14). These portions in contact with the skin serve in this case to ensure protection of this latter.

It is worthy of note in this connection that depilation blades having different contours can be combined in one and the same depilation roller. At all events it is an advantage to provide blades without any recessed portions at each end of the depilation roller so as to hold the skin outside said roller. This accordingly prevents pulling of the skin as the hairs are being removed. It is also possible by this means to dispense with the skin protection grid which usually has to be provided in depilating appliances of the type under consideration. This is an advantage since the presence of a grid of this type impairs the efficiency of the appliance.

As has already been indicated, the chief advantage of the appliance in accordance with the invention lies in the fact that the gripping action of the depilation blades takes place by pivotal displacement of two adjacent blades towards each other and not by deformation and compression of all the blades of the depilation roller as is the case in the prior art appliance recalled earlier. In point of fact, this mode of gripping of the depilation blades by pivotal displacement has an advantage in that it is possible to provide a relatively large initial spacing of the different blades, thus facilitating the penetration of the hairs into the depilation roller. Moreover, this solution has the advantage of being much more simple than that provided in the appliance mentioned earlier in which there existed a moving comb for clamping hairs against the blades of the depilation roller. For these different reasons, the efficiency and reliability of the present appliance are considerably improved with respect to earlier appliances of the same type.

What is claimed is:

1. A depilating appliance for plucking out hairs to be removed, comprising a rotatable roller (4) comprised by a series of pinching blades (5*a*, 5*b*–5*c*, 5*d*) disposed side by side, a rotatable central shaft (6, 6*c*) on which the blades (5*a*, 5*b*–5*c*, 5*d*) are carried and by which the blades are driven in rotation, means mounting said blades (5*a*, 5*b*–5*c*, 5*d*) on said shaft (6, 6*c*) for pivoting at least some of said blades about separate stationary axes (X—X') perpendicular to said shaft (6, 6*c*), a small casing (1) which can be held in one hand and within which said blades are disposed, said casing having an opening (3) therethrough through which gripping portions (16) of said blades project, and means for pivoting at least some of said blades about said separate axes (X—X') mechanically responsive to rotation of said roller (4) such that adjacent said gripping portions (16) of a plurality of pairs of said pivoting blades projecting through said opening contact each other simultaneously, so as to pinch hairs between the blades to pluck them out, said pivoting means comprising a pair of bars on opposite longitudinal sides of and parallel to said shaft with the shaft disposed between the bars of said pair, one said bar contacting a plurality of said blades on one side of said shaft, the other said bar contacting the same plurality of blades on the opposite side of said shaft, and means for simultaneously moving said bars in directions opposite to each other and parallel to said shaft.

2. A depilating appliance according to claim 1, there being two said pairs of bars with the bars of one said pair being disposed side-by-side with the bars of the other said pair, said moving means being adapted to move said side-by-side bars in opposite said directions and the blades moved by one said pair of bars alternating with the blades moved by the other said pair of bars.

3. A depilating appliance according to claim 1, at least some of said blades having at their periphery recesses disposed between said gripping portions.

* * * * *